US005129412A

United States Patent [19]

Hendry

[11] Patent Number: 5,129,412

[45] Date of Patent: Jul. 14, 1992

[54] AERODYNAMIC BLENDER

[75] Inventor: Ronald G. Hendry, Los Osos, Calif.

[73] Assignee: SAES Pure Gas, Inc., San Luis Obispo, Calif.

[21] Appl. No.: 697,109

[22] Filed: May 8, 1991

[51] Int. Cl.[5] ..... B01F 5/02

[52] U.S. Cl. ..... 137/1; 48/180.1; 48/189.1; 137/896

[58] Field of Search ..... 137/1, 888, 889, 890, 137/896, 897, 898; 48/180.1, 189.1

[56] References Cited

U.S. PATENT DOCUMENTS

| | | | |
|---|---|---|---|
| 1,195,915 | 8/1916 | Damrow | 137/888 X |
| 2,321,483 | 6/1943 | Haedike | 48/180.1 |
| 2,353,865 | 7/1944 | Armstrong | 137/890 X |
| 3,257,180 | 6/1966 | King | 48/180.1 |

*Primary Examiner*—Robert G. Nilson
*Attorney, Agent, or Firm*—Daniel C. McKown

[57] ABSTRACT

A blender designed on aerodynamic principles produces a thorough mixing of a number of solute gases with a diluent gas, so that the output of the blender is homogeneous to a high degree. The solute gases are supplied at desired rates by a flow controller upstream of the blender, and the blender is designed to mix these solute gases without altering the desired composition. This is accomplished by discharging the solute gases into a region devoid of turbulence, namely, near the entrance of a compression chamber. As the discharged gases approach the constriction of the venturi, a violent turbulence takes place, thereby thoroughly mixing and blending the gases. After passing through the constriction of the venturi, the gases enter a second expansion chamber which slows the flow to permit further blending to occur by molecular diffusion. A second compression chamber follows the second expansion chamber and serves to impart a final blending action while reducing the diameter of the flow path to that of the discharge pipe.

1 Claim, 1 Drawing Sheet

AERODYNAMIC BLENDER

BACKGROUND OF THE INVENTION

1. Field of the Invention

The present invention is in the field of gas dynamics, and specifically relates to a device for thoroughly mixing one or more solute gases with a diluent gas so as to provide a blended mixture that is extremely homogeneous so that it can be used as a standard in certain applications in the semiconductor industry.

2. The Prior Art

In U.S. Pat. No. 3,799,195 issued Mar. 26, 1974, Hermans describes a device whose objective is to achieve a strictly constant ratio between two components of a gas mixture in spite of large variations in the flow rate. One of the gases flows axially into the large end of the converging chamber of a venturi, and the other gas is introduced transversely to the axis of the venturi at the region of maximum velocity. The gases become mixed as they flow through the expansion chamber of the venturi. The contracting chamber includes a nozzle at its smallest diameter portion, and the position of this nozzle relative to the expansion chamber is altered in a controlled manner to vary the mixture ratio.

In U.S. Pat. No. 2,493,387 issued Jan. 3, 1950, Campbell shows a flow mixer in which the diluent gas enters axially through a short compression chamber while the solute gas is introduced transversely to the axis of the venturi at the point of maximum velocity. Mixing occurs in an expansion chamber.

Japanese Patent No. 0099264 issued Aug. 4, 1979 shows a device for the simultaneous dilution of several kinds of liquid. The solutes are introduced transversely to the axis of a venturi at the point of maximum flow velocity.

The above patents have in common the technique of introducing the solute at the point of maximum velocity, which is also the point of least pressure or greatest suction. There may be reasons for this, but in any case, the present invention employs a different technique. Also, most prior art devices inject the solute in a direction transverse to the axis of the venturi, i.e., radially. The present invention employs a different approach.

SUMMARY OF THE INVENTION

It is an objective of the present invention to provide a device for completely mixing a number of gases so that the mixture in the gas stream leaving the device is extremely homogeneous. As many as nine gases can be mixed with an extremely high degree of control.

The gases to be blended in the present invention have already been metered by means of a flow controller located upstream of the aerodynamic blender of the present invention.

In accordance with the present invention, the diluent gas enters the device in an axial direction at the small end of an expansion chamber. Next, the diluent gas flows into a converging pressure chamber, and the solute gases are introduced at a slight overpressure in this converging chamber. The solute gases are introduced in a direction parallel to the flow in the converging chamber. The smaller end of the converging chamber is connected by a short cylindrical section to a second diverging expansion chamber, so that the converging chamber, the cylindrical portion, and the second expansion chamber form a venturi. Following the expansion chamber, the mixed and blended gases enter a second converging chamber, the smaller end of which is the outlet of the device.

The device and its operation will be explained in greater detail below in connection with the drawing, which is included for purposes of explanation but is not intended to limit the present invention.

DETAILED DESCRIPTION OF THE PREFERRED EMBODIMENT

Figure 1:
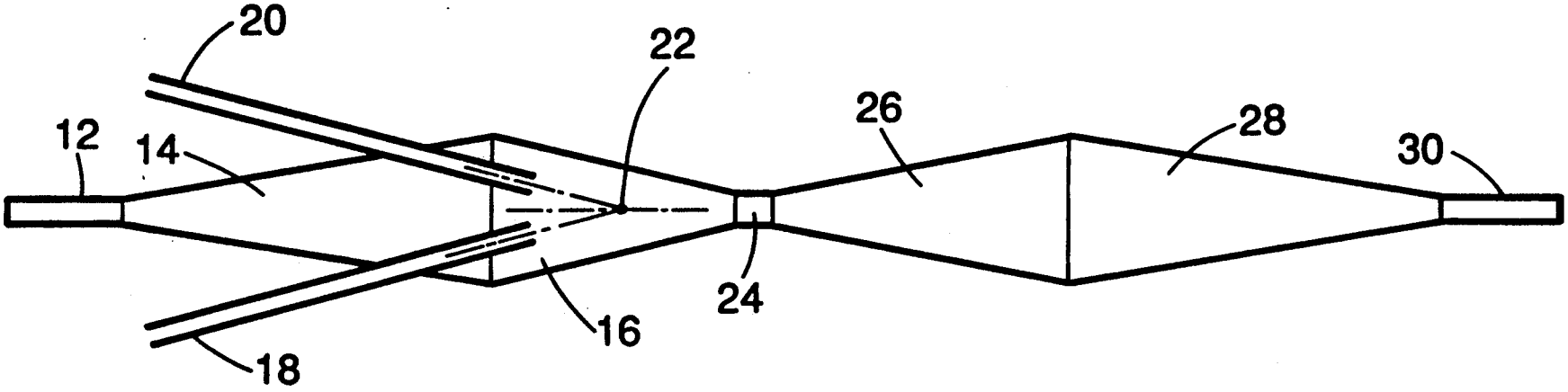
FIG. 1 is a diagram showing a side elevation cross-sectional view of a preferred embodiment of the present invention.

The diluent gas, which is usually an inert gas such as nitrogen or argon, enters the aerodynamic blender of the present invention through the inlet pipe 12. The diluent then flows into the first expansion chamber 14. The first expansion chamber 14 serves an important practical purpose in that it provides, at its larger end, sufficient space to accommodate the solute gas supply tubes, of which the tubes 12, 20 are typical. The first expansion chamber 14 also serves to avoid turbulence in the diluent gas. Such turbulence is undesirable in the portion of the first compression chamber 16 immediately in front of the discharge ends of the solute gas supply tubes. Such turbulence implies large variations in the local pressure, which could alter the gas mixture by momentarily speeding up the discharge from one of the solute gas supply tubes while simultaneously impeding the discharge from another of the solute gas supply tubes.

The desirability of maintaining a turbulence-free laminar flow up to a point slightly ahead of the solute gas supply tubes accounts for the angle at which those tubes extend into the first compression chamber 16. In accordance with the present invention, the axis of each solute gas supply tube is parallel to the wall of the first compression chamber, give or take several degrees. In various embodiments of the present invention, there may be as many as nine solute gas supply tubes equally spaced around the axis of the aerodynamic blender.

In accordance with the present invention, the axes of the solute gas supply tubes intersect at a single point on the axis of the blender, called the focal point. In accordance with the present invention, the focal point is located between 40% and 65% of the way from the large end of the first compression chamber to the small end of the first compression chamber. In a preferred embodiment, the focal point is located 60% of the way from the large end of the first compression chamber to its smaller end.

In accordance with the present invention, the solute gas tubes discharge into the first compression chamber, which means that the surrounding diluent gas is speeding up; however, the velocity of the solute gas is greater than the velocity of the diluent gas. The purpose of discharging the solute gas in a compression chamber as opposed to an expansion chamber is to promote mixing. If the solute were introduced into an expanding gas flow, it would not be thoroughly mixed with the diluent because the gases in an expansion chamber have already started to establish a boundary layer and laminar flow, which is the opposite of mixing.

By the time the flowing gases have progressed to the focal point 22, the flow is quite turbulent, thereby assuring good mixing of the solute gases. This turbulent flow becomes ever more frenetic as the gases approach the most constricted portion 24 of the venturi, and this extreme turbulence blends the solute gases very thoroughly.

The most constricted portion 24 is followed by a second expansion chamber 26 which slows the flow of gas thereby giving more time for molecular mixing, i.e., diffusion, to occur.

Thereafter, a second compression chamber 28 reduces the diameter to that of the outlet pipe 30. A further, final, blending takes place in the second compression chamber.

In accordance with the present invention, the angle between the axis of the blender and the wall of the expansion chambers should be in the range of 5 degrees to 20 degrees, and angles in the range from 10 to 15 degrees are used in the preferred embodiment. In contrast, the angle between the axis of the blender and the wall of a compression chamber may be as large as 45 degrees, but in the preferred embodiment, angles in the range of 10 degrees to 15 degrees are preferred.

Thus, there has been described an aerodynamic blender for blending a number of gases with a diluent gas. The flow rates of the solute gases are controlled by a flow controller located upstream of the blender of the present invention. In the present invention, the solute gases are discharged into an area of very low turbulence so that turbulence will not interfere with the desired flow rates. After the solute gases have been discharged in the first compression chamber, the violent mixing ensues because the discharge of the solute gases deliberately upsets the equilibrium of the flow of the diluent gas. This violent turbulence then provides a most thorough blending of the discharged gases.

What is claimed is:

1. A method of thoroughly mixing one or more solute gases with a diluent gas to provide a blended gas that is extremely homogeneous, comprising the steps of:

introducing the diluent gas axially into a diverging chamber to reduce turbulence in the diluent gas stream;

converging the diluent gas stream to accelerate it by conducting the diluent gas stream into a converging chamber;

injecting a solute gas into the diluent gas stream at a location where the diluent gas stream is accelerating, the solute gas being injected in the direction of the local flow of the diluent gas stream, whereby the solute gas is discharged at constant pressure, and whereby the flow pattern downstream of the point of injection is deliberately upset by the injected solute gas causing turbulence;

increasing the turbulence by passing the gas mixture through a venturi, whereby the solute gas becomes thoroughly mixed with the diluent gas.

* * * * *